US007774968B2

(12) United States Patent
Nearman et al.

(10) Patent No.: US 7,774,968 B2
(45) Date of Patent: Aug. 17, 2010

(54) TRANSPORTABLE ELECTRONIC SIGN DISPLAY SYSTEM

(75) Inventors: Nathan L. Nearman, Brookings, SD (US); Mark D. Dennis, Dell Rapids, SD (US); Kent S. Miller, Brookings, SD (US); John Hage, Sioux Falls, SD (US)

(73) Assignee: Daktronics, Inc., Brookings, SD (US)

( * ) Notice: Subject to any disclaimer, the term of this patent is extended or adjusted under 35 U.S.C. 154(b) by 159 days.

(21) Appl. No.: 11/796,649

(22) Filed: Apr. 27, 2007

(65) Prior Publication Data

US 2008/0263924 A1 Oct. 30, 2008

(51) Int. Cl.
*F09F 7/00* (2006.01)

(52) U.S. Cl. ..... 40/605; 292/240; 403/350

(58) Field of Classification Search ..... 40/605; 292/240, 300, 304, 341.17; 403/348, 350, 403/352, 322.4; 24/287, DIG. 55, DIG. 56, 24/DIG. 60

See application file for complete search history.

(56) References Cited

U.S. PATENT DOCUMENTS

| | | | | |
|---|---|---|---|---|
| 4,439,971 | A * | 4/1984 | Rutherford | 312/263 |
| 4,561,811 | A * | 12/1985 | Womack | 408/1 R |
| 5,160,224 | A * | 11/1992 | Schwiebert | 410/82 |
| 6,704,989 | B1 * | 3/2004 | Lutz et al. | 29/428 |
| 7,055,271 | B2 * | 6/2006 | Lutz et al. | 40/605 |

* cited by examiner

*Primary Examiner*—Joanne Silbermann
(74) *Attorney, Agent, or Firm*—Schwegman, Lundberg, & Woessner, P.A.

(57) ABSTRACT

A transportable electronic sign display system having modular cabinets which support electronic display modules and electronics having male and female latching assemblies connecting adjacent electronic display modules. Robust male and female latching assemblies at the top and bottom of electronic display modules provide for forcible positive action latching between vertically situated electronic display modules to provide a minimally visible horizontally oriented seam therebetween. Side latches between horizontally situated electronic display modules assemblies provide for latching to provide a minimally visible vertically oriented seam therebetween.

36 Claims, 12 Drawing Sheets

TRANSPORTABLE ELECTRONIC SIGN DISPLAY SYSTEM

CROSS REFERENCES TO RELATED APPLICATIONS

This patent application is also related to patent application Ser. No. 10/688,304 filed Oct. 17, 2003, entitled "Electronic Display Module Having a Four-Point Latching System for Incorporation into an Electronic Sign and Process," which is now U.S. Pat. No. 7,055,271, and is incorporated herein by reference.

BACKGROUND OF THE INVENTION

1. Field of the Invention

The present invention is for a transportable electronic sign display system, and more particularly relates to a transportable electronic sign display system having latch assemblies which mutually secure modular cabinets of the transportable electronic sign display system to one another.

2. Description of the Prior Art

Prior art methods of attaching transportable electronic sign system display cabinets required a high degree of accuracy in placing the cabinets upon or next to each other, especially along the horizontally oriented top and bottom plates or panels between each. Often, methods were ineffective and/or cumbersome for attaching display cabinets on uneven stage or ground surfaces because the latching devices required tight tolerances in order for the latches to align and secure properly. Attachment methods often were not of a simple design whereby many prior art cabinet latching devices contained numerous moving parts comprising fasteners where the stage hand assemblers needed specialized training to learn how to properly assemble and latch the displays. Complexity and complicated designs often resulted in an expensive device having difficult installation procedures. In instances where bolts were used as fasteners, the assembly time increased because bolts do not assemble quickly and the use of such is labor intensive. Pins were often used for attaching display cabinets where assembly time was saved but the safety level provided by the use pins was not sufficient. Other time consuming methods include the use of screw and worm gears to fasten the display cabinets together and required proper tightening torque and extra tools for assembly. Previously used methods of connecting were not always rugged and durable and frequent transport, setup and teardown of the display cabinets caused breakdown of the parts and a short life span. What is needed is a transportable electronic sign system display which overcomes the shortcomings of the previous art transportable electronic sign display systems.

SUMMARY OF THE INVENTION

The general purpose of the present invention is to provide a transportable electronic sign display system which features new and novel attachment methods which are used to connect the modular cabinets comprising a transportable electronic display sign system. With this invention, lengthy setup time is reduced because there is a large tolerance of initial cabinet placement for the mating latch assemblies to perform the function of pulling and holding the display cabinets in place. Assembly and tear down time is minimized due to the novel structure of latch assemblies.

The invention allows for multiple configurations of modular cabinet stacks. The modular cabinets are commonly stacked vertically only, horizontally only, or vertically and horizontally. Other configurations can take place such as stacking displays at an angle. Separate parts and latches perform the connection along vertical and horizontal seams. The modular cabinets are preferably comprised of formed sheet metal, but other materials can be used such as metal extrusions. Formed sheet metal is lighter and has a more true shape than extrusions whereby a modular cabinet is easier to move. Mating panels using formed sheet metal create as tight of seams as possible between the display modules to maintain consistent placement of the display modules for viewing quality.

Opposed male and female latch assemblies, preferably in pairs, are included at the top and bottom respectively of the modular cabinets. More precisely, male latch assemblies at the top of a lower modular cabinet align and mate to female latch assemblies on the bottom of an upper modular cabinet and accommodate large tolerance in vertical or horizontal irregularities in initial modular cabinet alignment. The female latch assemblies easily engage and couple with components of the male latch assembly whereby the female latch assembly is actuated by a simple handle to draw the male latch assembly and the female latch assembly together whereupon the associated upper and lower modular cabinets are also drawn together. The handle position on the female latch assembly gives the assembler(s) a quick visual reference as to whether or not the latches are locked in place.

According to one or more embodiments of the present invention, there is provided a transportable electronic sign display system including opposed channels, side plates attached to the opposed channels, top and bottom plates secured to the top and bottom of the opposed channels, female latch assemblies secured to the bottom of the opposed channels, retainer plates secured to the lower regions of the opposed formed channels and above the female latch assemblies, male latch assemblies secured to the top of the opposed channels, a vertically aligned front mounting panel including a horizontally aligned extension plate where the front mounting panel secures to the front portion of the opposed channels, a horizontally aligned bracket extending between the lower regions of the opposed channels, male and female side latches and spacers located between the opposed channels and corresponding side plates, a rear panel and a rear vent panel and one or more electronic display modules.

One significant aspect and feature of the present invention is the accommodation of large tolerances in initial cabinet positioning where male and female latch assemblies can effectively cooperate to pull the modular cabinets together.

Another significant aspect and feature of the present invention is the use of male and female latch assemblies in association with the horizontal seam between stacked modular cabinets to allow for large tolerance in vertical or horizontal irregularities in initial cabinet alignment where such latch assemblies pull the modular cabinets into alignment so the seams between the modular cabinets are tight.

Yet another significant aspect and feature of the present invention is the use of rotatable inclined ramps in a female latch assembly to firmly engage and lockingly cooperate with a male shaft of a male latch assembly.

Still another significant aspect and feature of the present invention is the advantage of simplicity in design having a minimum number of components in the male and female latch assemblies and even fewer moving parts used to execute the tightening and latch-down of the modular cabinets.

A still further significant aspect and feature of the present invention is the use of a wave washer in the female latch assembly to decrease the dead stop impact as the modular cabinets initially come together.

A still further significant aspect and feature of the present invention is that no special tools are required for vertical connection of one modular cabinet to another.

A further significant aspect and feature of the present invention is the saving of time in setup and teardown of the modular cabinets comprising the transportable electronic sign display system.

Yet another significant aspect and feature of the present invention is rugged, robust and durable design to better handle frequent shipping and possible abuse.

Having thus briefly described embodiments of the present invention and having mentioned some significant aspects and features of the present invention, it is the principal object of the present invention to provide a transportable electronic sign display system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
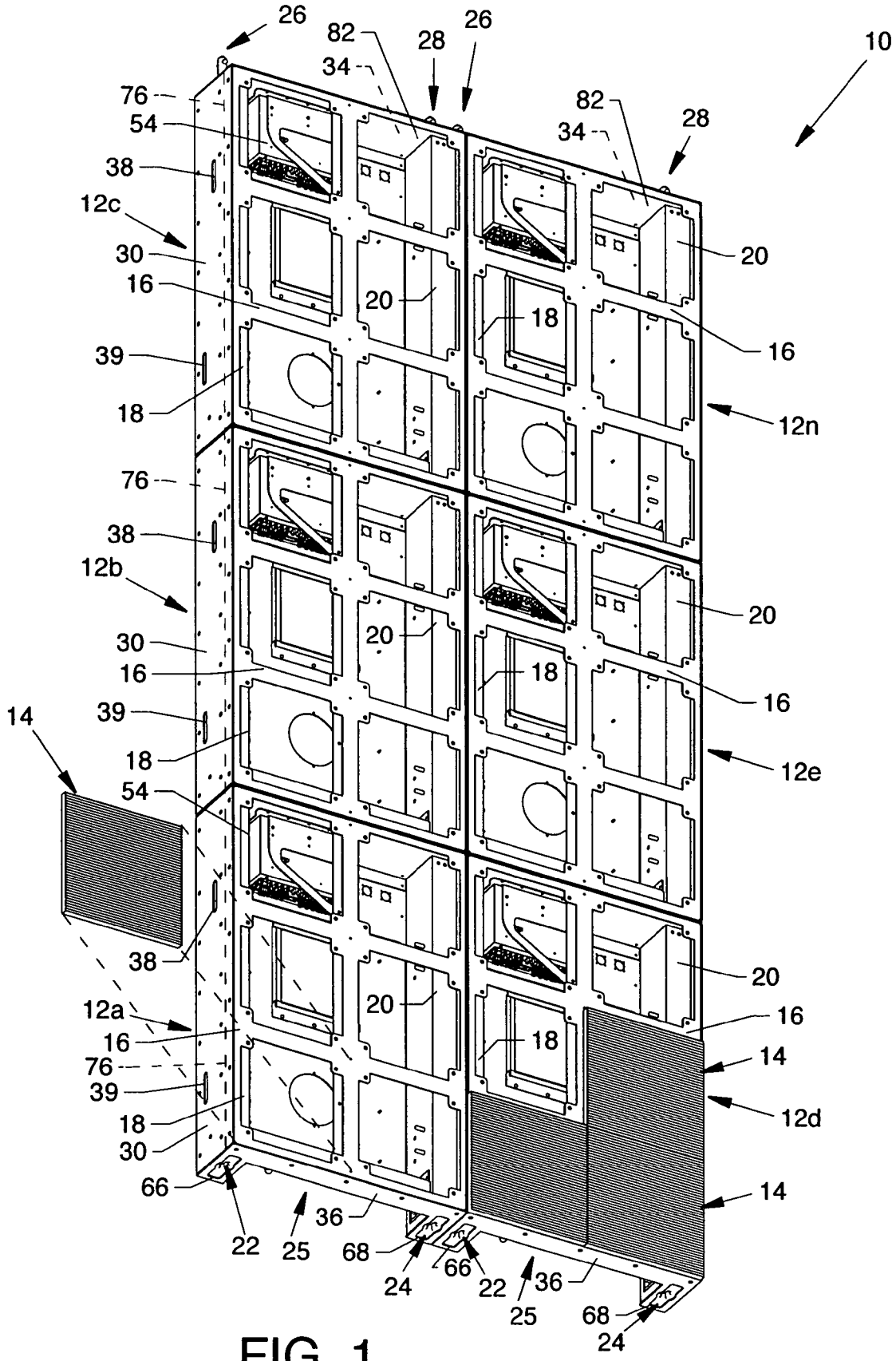
FIG. 1 is a partially exploded isometric front view of a transportable electronic sign display system, the present invention.
Figure 2:
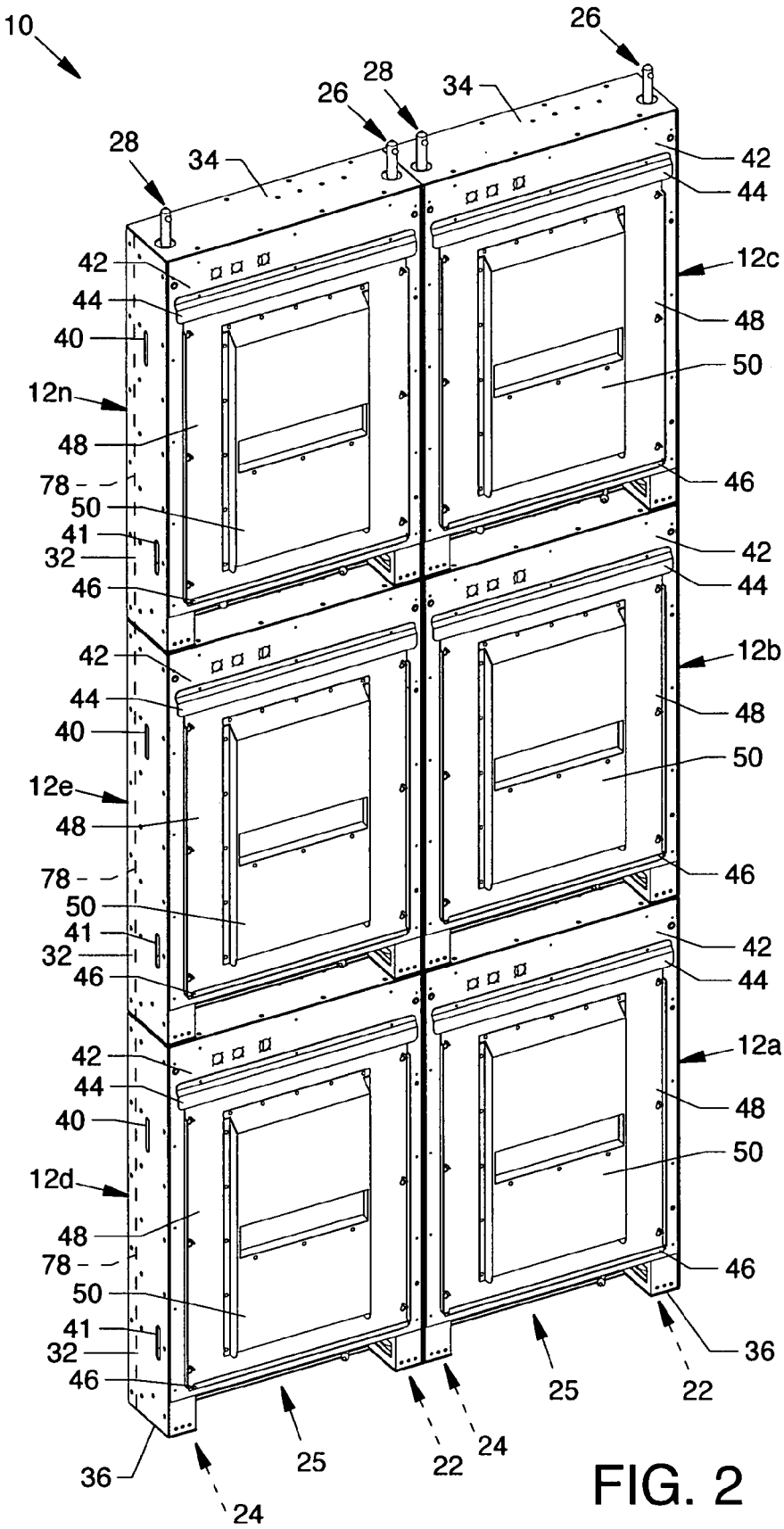
FIG. 2 is an isometric rear view of the transportable electronic sign display system.

FIG. 1 is a partially exploded isometric front view of a transportable electronic sign display system 10, and FIG. 2 is an isometric rear view of the transportable electronic sign display system 10 each showing components of the present invention. The invention is comprised of a plurality of stacked modular cabinets 12*a*-12*n* where each modular cabinet 12*a*-12*n* is made of a light weight material such as aluminum or other suitable light weight material, including a plurality of electronic display modules 14. For the purpose of brevity and clarity, only four electronic display modules 14 are shown in FIG. 1. Each of the modular cabinets 12*a*-12*n* includes a mounting panel 16 for accommodation of a plurality of the electronic display modules 14 where the electronic display modules 14, mounting panel 16 and the four-point latching system are described in U.S. Pat. No. 7,055,271 entitled "Electronic Display Module Having a Four-Point Latching System for Incorporation into an Electronic Sign and Process," which is incorporated herein by reference. Each of the modular cabinets 12*a*-12*n* include opposed channels 18 and 20, which preferably are formed channels, which serve, as later described in detail, as mounting locations for opposed mirror image like female latch assemblies 22 and 24. The female latch assemblies 22 and 24 mount in the lower regions of the opposed channels 18 and 20 in a location at the bottom of each modular cabinet 12*a*-12*n*. The opposed channels 18 and 20 also serve, as later described in detail, as mounting locations for opposed mirror image like male latch assemblies 26 and 28. The male latch assemblies 26 and 28 mount in the upper regions of the opposed channels 18 and 20 in a location at the top of each modular cabinet 12*a*-12*n*. Each of the modular cabinets 12*a*-12*n* includes a side panel 30 and an opposed side panel 32, a top panel 34, and a configured bottom panel 36. A space 25 is located between the lower region of the channels 18 and 20 and a bracket 64 (FIG. 3) to accommodate operation of actuator handles of the female latch assemblies 22 and 24, shown later in detail. Male side latch assemblies 38 and 39 are accessible through the upper and lower levels of each of the side panels 30, respectively, and female latch assemblies 40 and 41 are accessible through the upper and lower levels of each of the side panels 32, respectively. Each of the modular cabinets 12*a*-12*n* includes a rear access panel 42, a dust cap channel 44 secured to the upper portion of the rear access panel 42, a bracket 46 secured to the lower region of the rear access panel 42, and a removably attached access panel cover 48 having a vent 50 which suitably secures over an opening 52 (FIG. 3) in the rear access panel 42 and between the dust cap channel 44 and the bracket 46. Electronic circuitry in enclosures 54 are also included in each of the modular cabinets 12*a*-12*n*.

Figure 3:
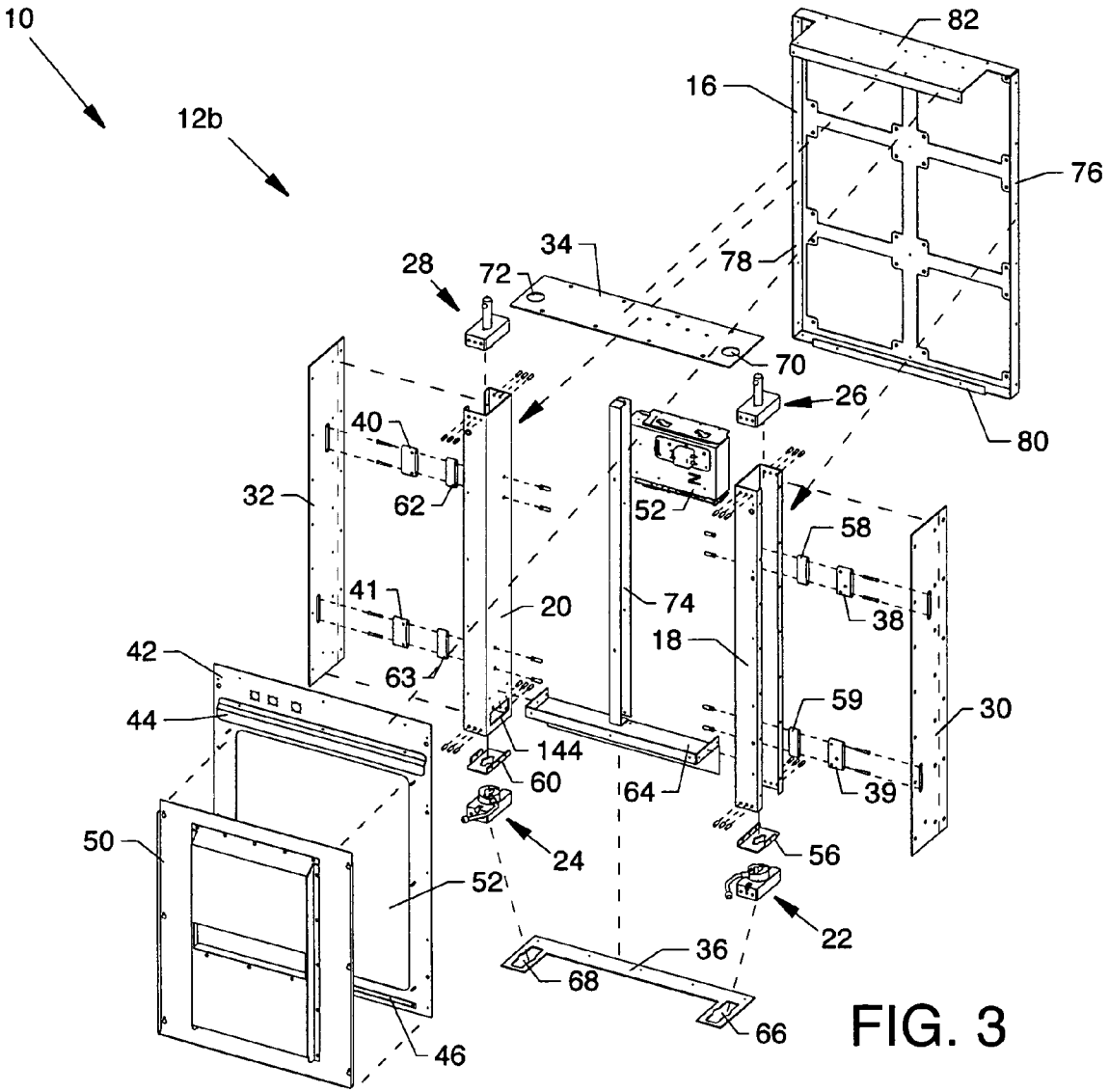
FIG. 3 is a partially exploded isometric view of a modular cabinet.

FIG. 3 is a partially exploded isometric view of the modular cabinet 12*b* comprising one portion of the transportable electronic sign display system 10. The electronic display modules 14 are not shown for the purpose of brevity and clarity. Centrally located components of the invention include the channels 18 and 20 and closely associated components which align and secure thereto where many components are in a mirrored relationship with like functioning components. Channel 18 serves as a mount for the female latch assembly 22 and a retainer plate 56 both of which suitably secure within the lower confines thereof such as by screws, rivets and the like. The channel 18 also serves as a mount for the male latch assembly 26 and a retainer plate 56 which suitably secures within the upper confines thereof, such as by screws, rivets and the like. The side panel 30 suitably secures to the lips of the channel 18, thereby forming a combined rigid columnar structure having male and female latching assemblies 26 and 22, respectively, mounted at the opposing ends thereof. The male side latch assemblies 38 and 39 mount to the channel 18 by the use of spacer mounting blocks 58 and 59 using suitable fasteners. Correspondingly and in mirror fashion, the opposing channel 20 serves as a mount for the female latch assembly 24 and a retainer plate 60, both of which suitably secure within the lower confines thereof, such as by screws, rivets and the like. Channel 20 also serves as a mount for the male latch assembly 28 which suitably secures within the upper confines thereof, such as by screws, rivets and the like. The side panel 32 suitably secures to the lips of the channel 20, thereby forming a combined rigid columnar structure having female and male latching assemblies 24 and 28, respectively, mounted at the opposing ends thereof. Female side latch assemblies 40 and 41 mount to the channel 20 by the use of spacer mounting blocks 62 and 63 and suitable fasteners.

Also included in the formation of the modular cabinet 12*b* are a plurality of horizontally oriented components extending between or along the top or bottom regions including a bracket 64 secured to and extending between the inwardly facing lower regions of the channels 18 and 20 and in alignment above the locations of the retainer plates 56 and 60, as well as in alignment above the locations of the female latch assemblies 22 and 24. The suitably secured configured bottom panel 36 extends across and between the bottom of the channels 18 and 20 juxtaposing the female latch assemblies 22 and 24. The bottom panel 36 includes openings 66 and 68 which are in close alignment with the female latch assemblies 22 and 24. The openings 66 and 68 allow access through the bottom panel 36 for entry and accommodation of part of the male latch assemblies 26 and 28 of a lower modular cabinet such as modular cabinet 12*a*. The suitably secured top panel 34 extends across and between the tops of the channels 18 and 20 juxtaposing the male latch assemblies 26 and 28 and includes openings 70 and 72. The openings 70 and 72 allow for extension therethrough of part of the male latch assemblies 26 and 28 for coupling with a higher modular cabinet such as modular cabinet 12*c*. A vertically oriented center channel 74, which preferably is a formed channel, is secured to and extends between the forward regions of the top panel 34 and the bracket 64 and also is in intimate supportive contact with the rear surface of the mounting panel 16. The mounting panel 16 secures in a position in front of the channels 16 and 18 by the use of vertically oriented side lips 76 and 78, a short extended bottom lip 80 and an elongated extended top lip 82. The widths of the panels 30 and 32 are greater than the widths of the channels 30 and 32, whereby the forward portion of the channels 30 and 32 extend forwardly beyond the most forward portions of the channels 30 and 32 to provide a mating surface for the overlapping secured joining of the side lips 76 and 78 to the forward portion of the channels 30 and 32 as can be seen in FIGS. 1 and 2. The elongated extended top lip 82 of the mounting panel 16 overlappingly joins and secures to the upper region of the rear access panel 42. The short extended bottom lip 80 of the mounting panel 16 overlappingly joins and secures to the lower region of the rear access panel 42.

Figure 4:
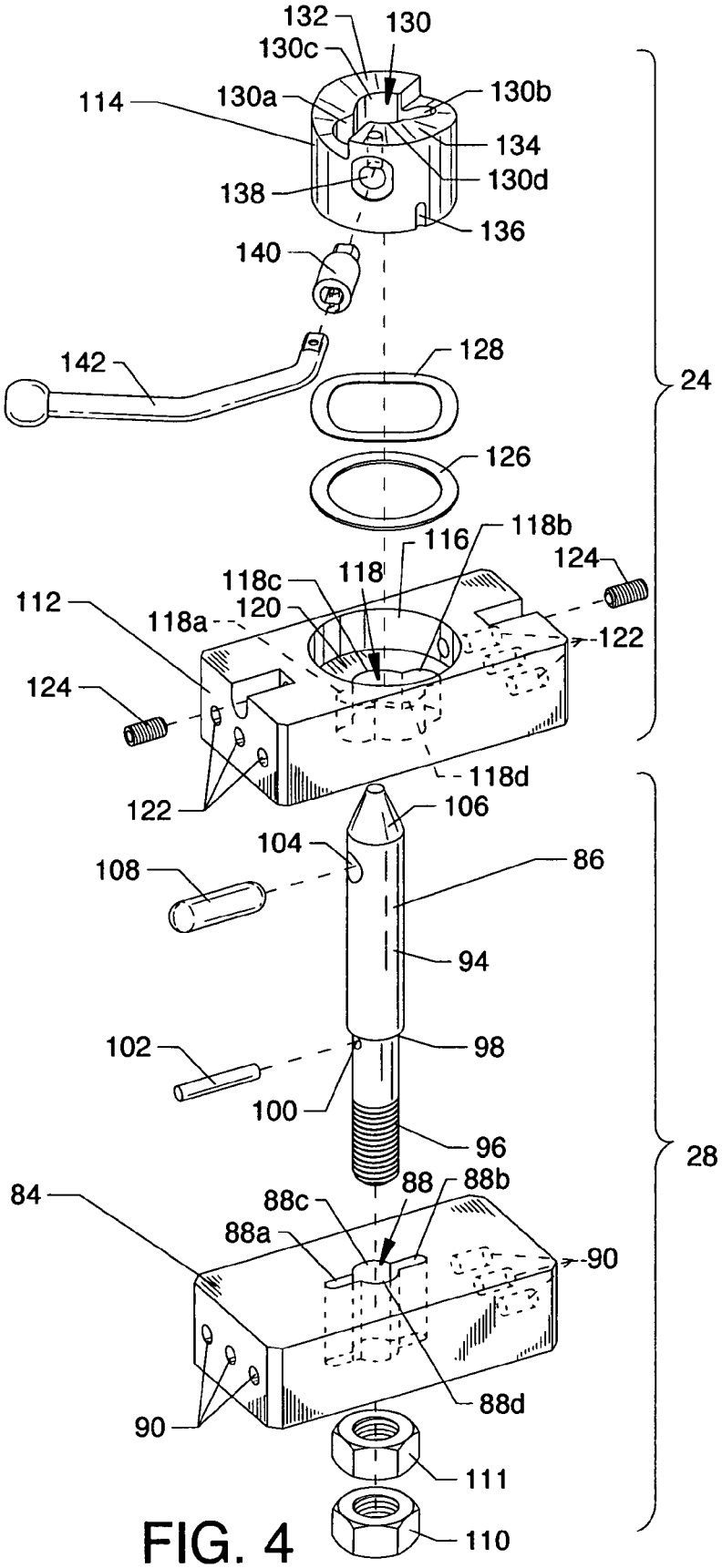
FIG. 4 is an exploded isometric view of the male latch assembly and the female latch assembly.
Figure 5:
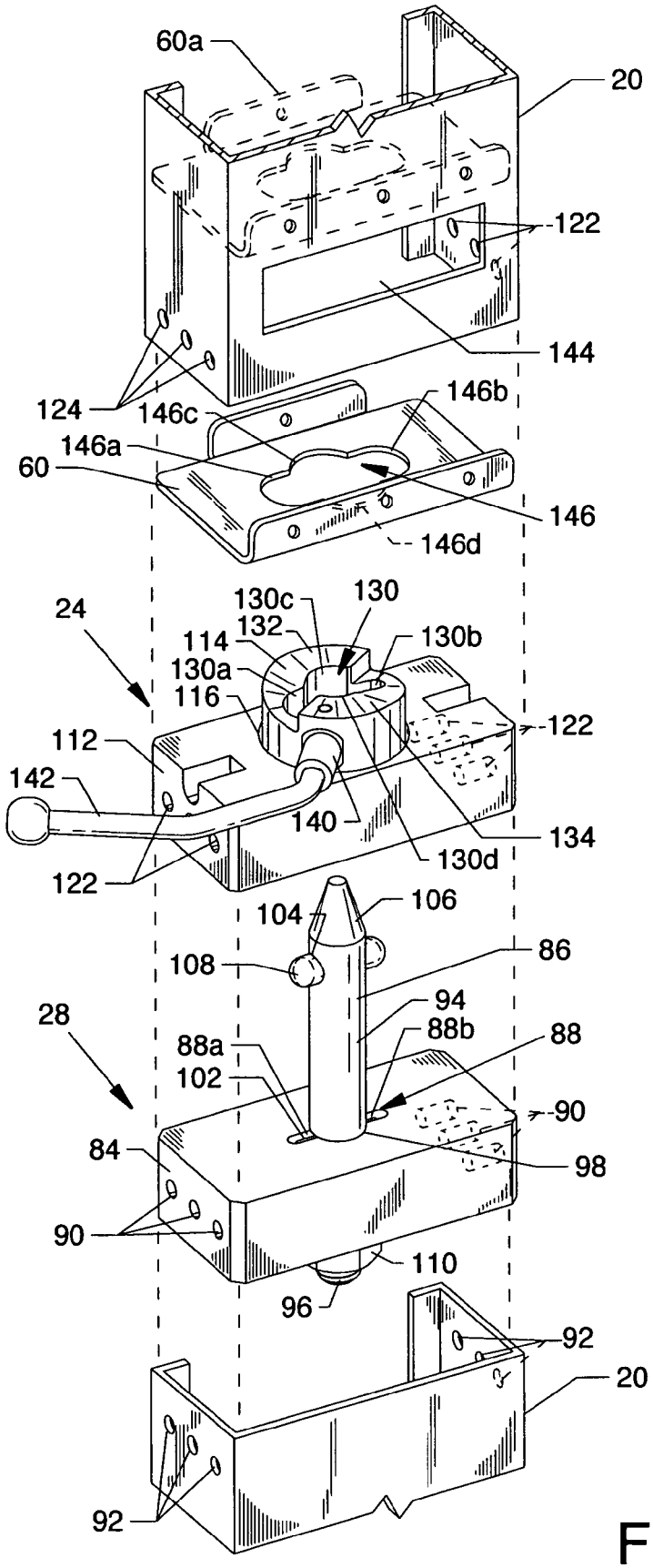
FIG. 5 is isometric view of the male latch assembly and the female latch assembly and other closely associate components.

FIG. 4 is an exploded isometric view of the male latch assembly 28 and the female latch assembly 24 and basic alignmental relationship, and FIG. 5 is an isometric assembled view of the male latch assembly 28 and the female latch assembly 24 of FIG. 4 showing the relationship with the ends of the channel 20 and the retainer plate 60. Top and bottom panels 34 and 36 are not shown for the purpose of brevity and clarity. The male latch assembly 28 includes a base 84 which serves as a mount for a round shaft 86. The base 84 includes a centrally located vertically oriented double keyed bore 88 extending entirely therethrough. For the purpose of brevity and for simplified terminology, a double keyed bore 88, or other double keyed bores in general, with reference to double keyed bore 88 as an example, can be described as a centralized symmetrical combination of opposed slots 88*a* and 88*b* of equal size with opposed central arcuate sections 88*c* and 88*d* of a larger radius. Such a double keyed hole allows for passage or fixing of a round shaft within the arcuate sections and for passage or fixation of a shaft mounted transverse pin within the opposed slots extending away from the arcuate sections. Double keyed holes are used in both the male latch assembly 28 and the female latch assembly 24, and in the retainer plate 60. The base 84 includes a plurality of threaded mounting holes 90 at opposite ends for mounting of the base 84 with suitable fasteners through corresponding body holes 92 at the upper end of the channel 20. The shaft 86 includes a non-threaded section 94 and a smaller radius threaded section 96 having a shoulder 98 therebetween. A transverse hole 100 is located in the threaded section 96 near the shoulder 98 for accommodation of a transverse mounted pin 102 which can be frictionally engaged therein or which can be slidingly engaged without the benefit of frictional engagement whereby capture of the pin 102 occurs when engaged within the double keyed bore 88. Another transverse hole 104 is located in the non-threaded section 94 near a tapered tip 106 for accommodation of a larger transverse pin 108 which can be engaged therein such as by frictional engagement or by other suitable fixation. Preferably, the pins 102 and 108 center in the holes 100 and 104, respectively, to extend equally therefrom on each side, such as partially shown in FIG. 5. The shaft 86 is inserted into the double keyed bore 88, whereby the upper portion of the threaded section 96 engages the arcuate sections 88*c* and 88*d* of the double keyed bore 88 and the opposed ends of the pin 102 extending from the threaded section 96 engage the slot sections 88*a* and 88*b* of the double keyed bore 88 the later engagement of which fixes the shaft 86 against rotation. Nuts 110 and 111 are then affixed to the threaded portion of the threaded shaft section 96 and tightened against the lower surface of the base 84 in locknut fashion to seat and secure the shoulder 98 against the immediate upper surface of the base 84 which extends outwardly from the double keyed bore 88.

The female latch assembly 24 includes a base 112 which serves as a mount for an adjustable rotary ramp 114. The base 112 includes a centrally located circular recess or race 116 having a centrally located vertically oriented double keyed bore 118 extending entirely through the bottom 120 of the race 116 to the bottom surface of the base 112. The double keyed bore 118 includes opposed slots 118*a* and 118*b* of equal size and opposed central arcuate sections 118*c* and 118*d* of a radius appropriately sized to provide non-restricted passage of the transversely mounted pin 108 of the shaft 86 and the non-threaded section 94 of the shaft 86, respectively. The base 112 includes a plurality of threaded mounting holes 122 at opposite ends for mounting with suitable fasteners through corresponding body holes 124 at the lower end of the channel 20. Spring loaded bullet catches 124 secure into the base 112 to extend partially through the wall of the race 116 in order to contact the adjustable rotating ramp 114, as later described in detail. A washer 126 and a wave washer 128 align in the bottom of the race 116 to aid in rotation of the adjustable rotating ramp 114 and to cushion modular cabinets 12*a*-12*n* during installation. The adjustable rotating ramp 114 is generally round in order to be suitably accommodated by the race 116. The adjustable rotating ramp 114 includes a double keyed bore 130 intersecting with dual functioning opposed inclined ramps 132 and 134. The double keyed bore 130 includes opposed slots 130*a* and 130*b* of equal size with opposed central arcuate sections 130*c* and 130*d* of a radius appropriately sized to provide non-restricted passage of the non-threaded section 94 of the shaft 86 and the transverse mounted pin 108 of the shaft 86 respectively. A detent 136 and an opposed detent 137 (FIG. 9) are included at the bottom outer edge of the adjustable rotating ramp 114. A bore 138 is included in the side of the adjustable rotating ramp 114 for accommodation of a handle mounting fixture 140 and an actuating handle 142. The retainer plate 60 (FIG. 5) in the form of a suitably mounted bracket secures, as also shown by dashed lines as 60*b*, in a location within the bottom region of the channel 20 just above an elongated opening 144 in the channel 20, the later of which accommodates movement of the handle 142. The retainer plate 60 includes double keyed bore 146 and includes opposed slots 146*a* and 146*b* of equal size with opposed central arcuate sections 146*c* and 146*d* of a radius appropriately sized to provide non-restricted passage of the non-threaded section 94 of the shaft 86 and the transversely mounted pin 108 of the shaft 86 respectively. The retainer plate 60 is located in near proximity to the top region of the adjustable rotary ramp 114 in order to retain the adjustable rotary ramp 114 within the race 116.

Figure 6:
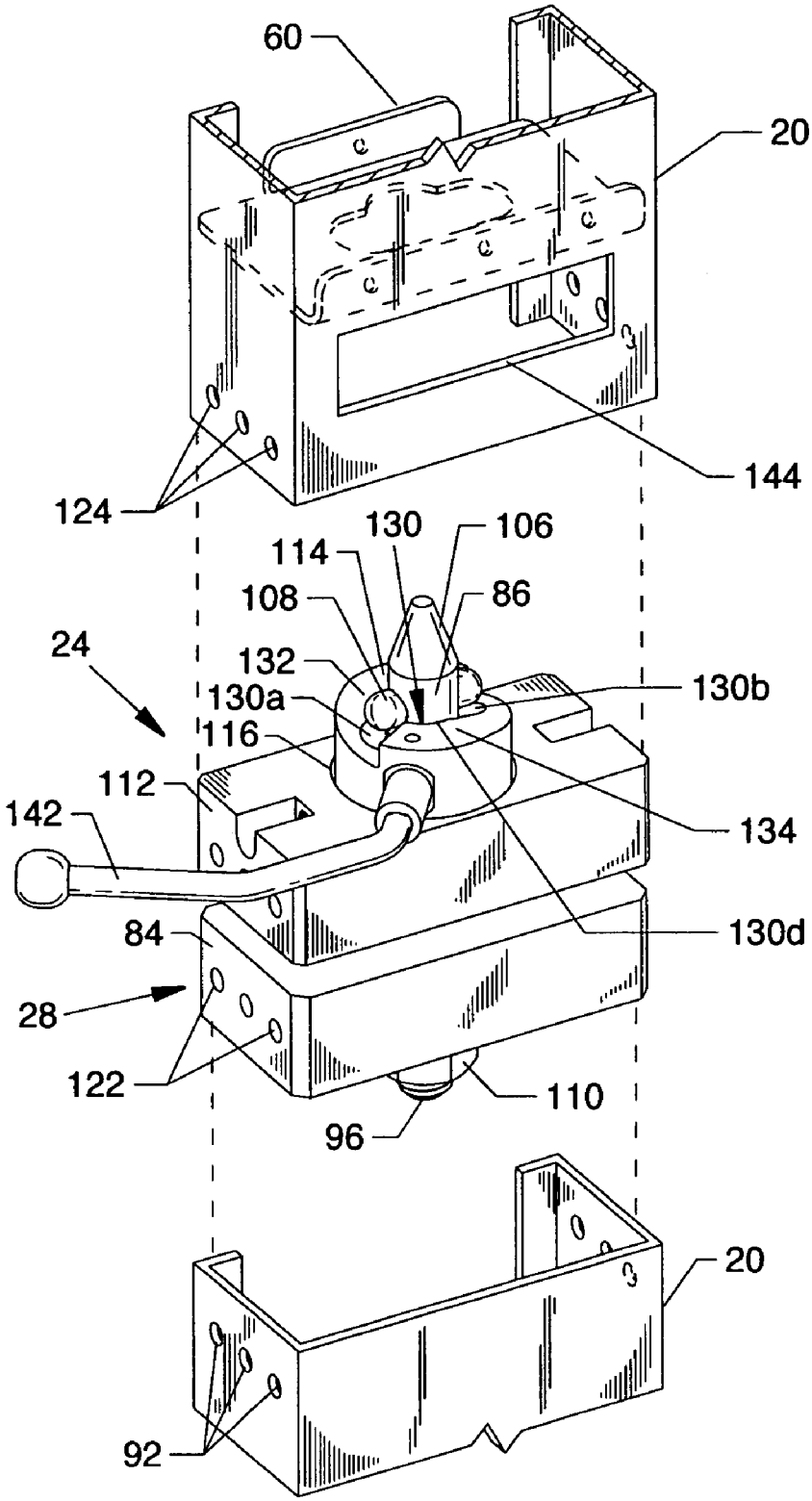
FIG. 6 shows the coupling and engagement of the male latch assembly with the female latch assembly.

FIG. 6 shows the coupling and engagement of the male latch assembly 28 with the female latch assembly 24 and the location of the retainer plate 60 shown in partially dashed lines. The male latch assembly 28 with the female latch assembly 24 are shown in the unlatched position, such as in the first step of engagement, for the purpose of vertically connecting one modular cabinet 12*a*-12*n* to another. Shown in particular is the upper portion of the shaft 86 of the male latch assembly 28 extending through and slightly beyond the center of the adjustable rotary ramp 114 of the female latch assembly 24, and more specifically, through the arcuate sections 130*c* and 130*d* of the double key bore 130 central to the adjustable rotary ramp 114. Also shown is the contacting relationship of the pin 108 of the shaft 86 to the inclined ramps 132 and 134 subsequent to passage through the slot sections 130*a* and 130*b* of the double key bore 130. Also shown is the location of the retainer plate 60 within the lower region of the channel 20 at a location just above the opening 144.

Figure 7:
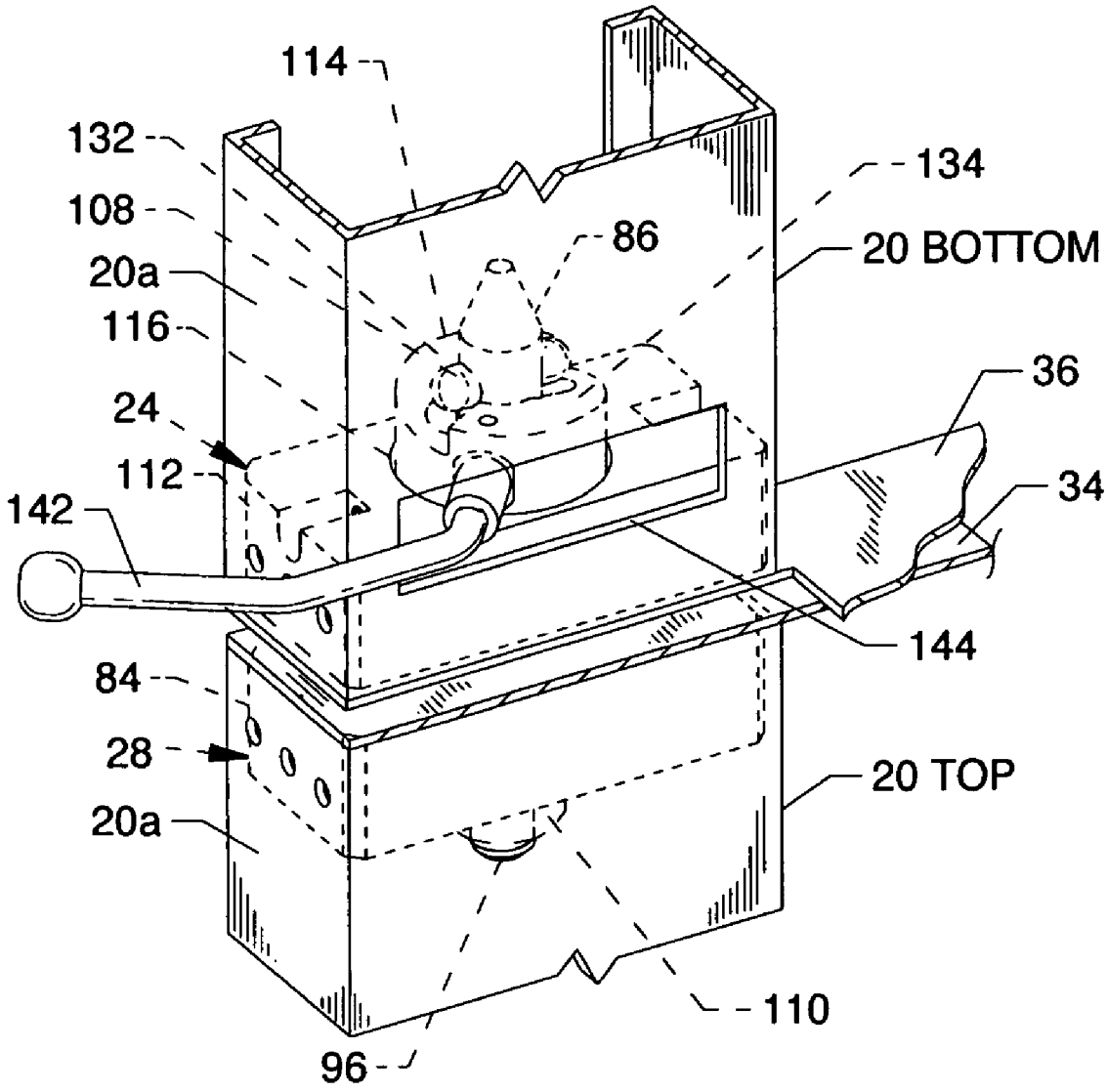
FIG. 7 shows the mounting of the male latch assembly secured in the top portion of a channel and the mounting of the female latch assembly secured in the bottom portion of a channel.

FIG. 7 shows the mounting of the male latch assembly 28 secured in the top portion of the channel 20 including the top panel 34 in close association therewith and also shows the mounting of the female latch assembly 24 secured in the bottom portion of the channel 20 including the bottom panel 36 in close association therewith where the female latch assembly 24 and the male latch assembly 28 are in the unlatched position. The actuating handle 142 extends through the opening 144 and protrudes rearwardly past and beyond a rear panel 20*a* of the channel(s) 20, thereby offering visual confirmation indicating such unlatched position. The retainer plate 60 is not shown for purposes of brevity and clarity.

Figure 8:
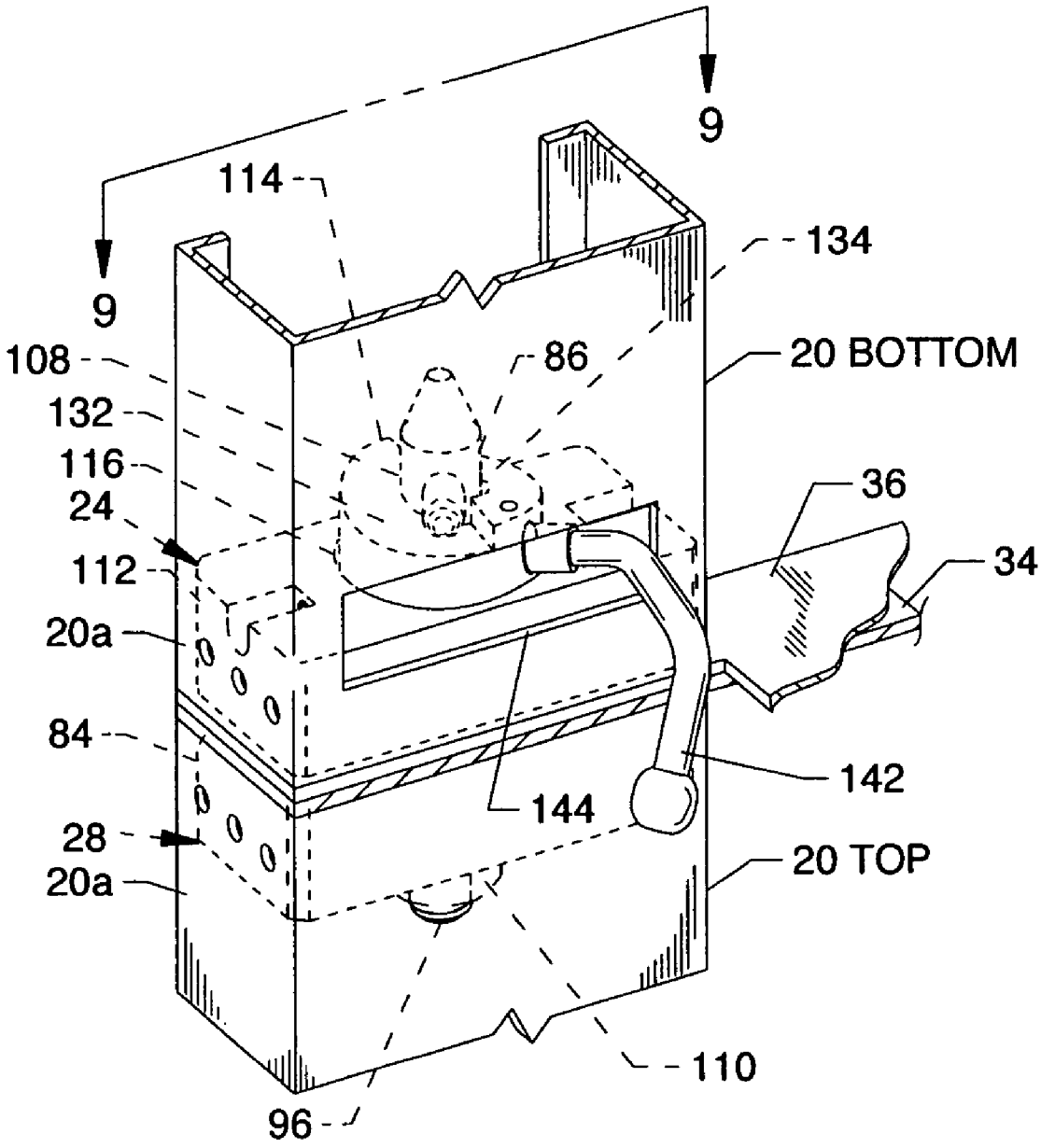
FIG. 8 is an illustration like FIG. 7 showing the latched or locked position of an actuating handle and a female latch assembly where the actuating handle is actuated to firmly and forcibly secure the male latch assembly to the female latch assembly.

FIG. 8 is an illustration like FIG. 7 showing the latched or locked position of the actuating handle 142 and the female latch assembly 24 where the actuating handle 142 is actuated to firmly and forcibly secure the male latch 28 assembly to the female latch assembly 24 resulting in the firm connection and attachment of one channel 20 to another channel 20. Resultantly, such action, also including the similar action of the female latch assembly 22 and male latch assembly 26, firmly and forcibly secures one modular cabinet 12*a*-12*n* to another modular cabinet 12*a*-12*n*. The wave washers 128 distribute force between the base 112 of the female latch assembly 24 and the adjustable rotary ramp 114 thereby maintaining forced contact between the pin 108 of the shaft 86 and the inclined ramps 132 and 134 of the adjustable rotary ramp 114 to ensure continual forced contact between the pin 108 and the adjustable rotary ramp 114. Such a forced relationship ensures sufficient frictional engagement in order to prevent rotational migration of the adjustable ramp 114. The actuating handle 142 extends through the opening 144 and protrudes away from the rear panel 20*a* and toward the mounting panel 16 to a locked "nested" position where such a position is interpreted as a latched and locked position. If, when sighting along the rear of the joined modular cabinets 12*a*-12*n*, no actuating handles are observed, then locking is thereby indicated. If any actuating handle 142 is visible, such as in the preceding figure, an unlocked position is indicated.

Figure 9:
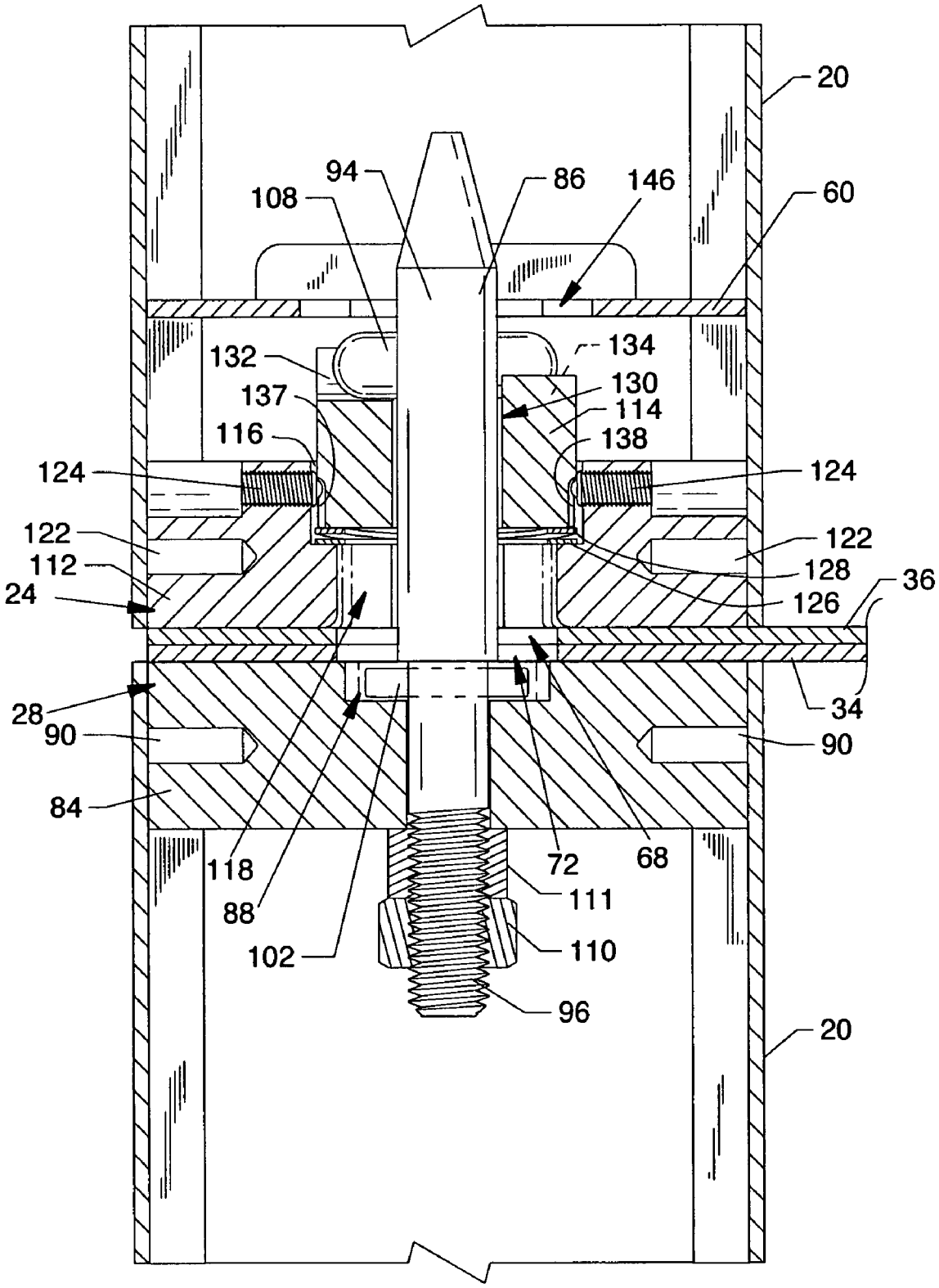
FIG. 9 is a cross section view of the female assembly and the male latch assembly in the closed or locked position along line 9-9 of FIG. 8.

FIG. 9 is a cross section view of the female assembly 24 and the male latch assembly 28 in the closed or locked position along line 9-9 of FIG. 8. The shaft 86 is shown extending through the double key bore 88 of the male latch assembly 28, through the opening 72 of the top panel 34, through the opening 68 of the bottom panel 36, through the double key bore 118 of the female latch assembly 24, through the double key bore 130 of the adjustable rotary ramp 114, and then through the double key bore 146 of the retainer plate 60. During rotation of the adjustable rotary ramp 114 by action of the actuating handle 142, the opposed inclined ramps 132 and 134 are brought to forcibly bear against the portions of the pin 108 extending from the shaft 86, thereby forcing the male latch assembly 28 and top panel 34 against the bottom panel 36 and the female latch assembly 24. The bullet catches 124 engage detents 136 and 137 to secure the adjustable rotary ramp 114 against inadvertent rotation within the race 116.

Figure 10:
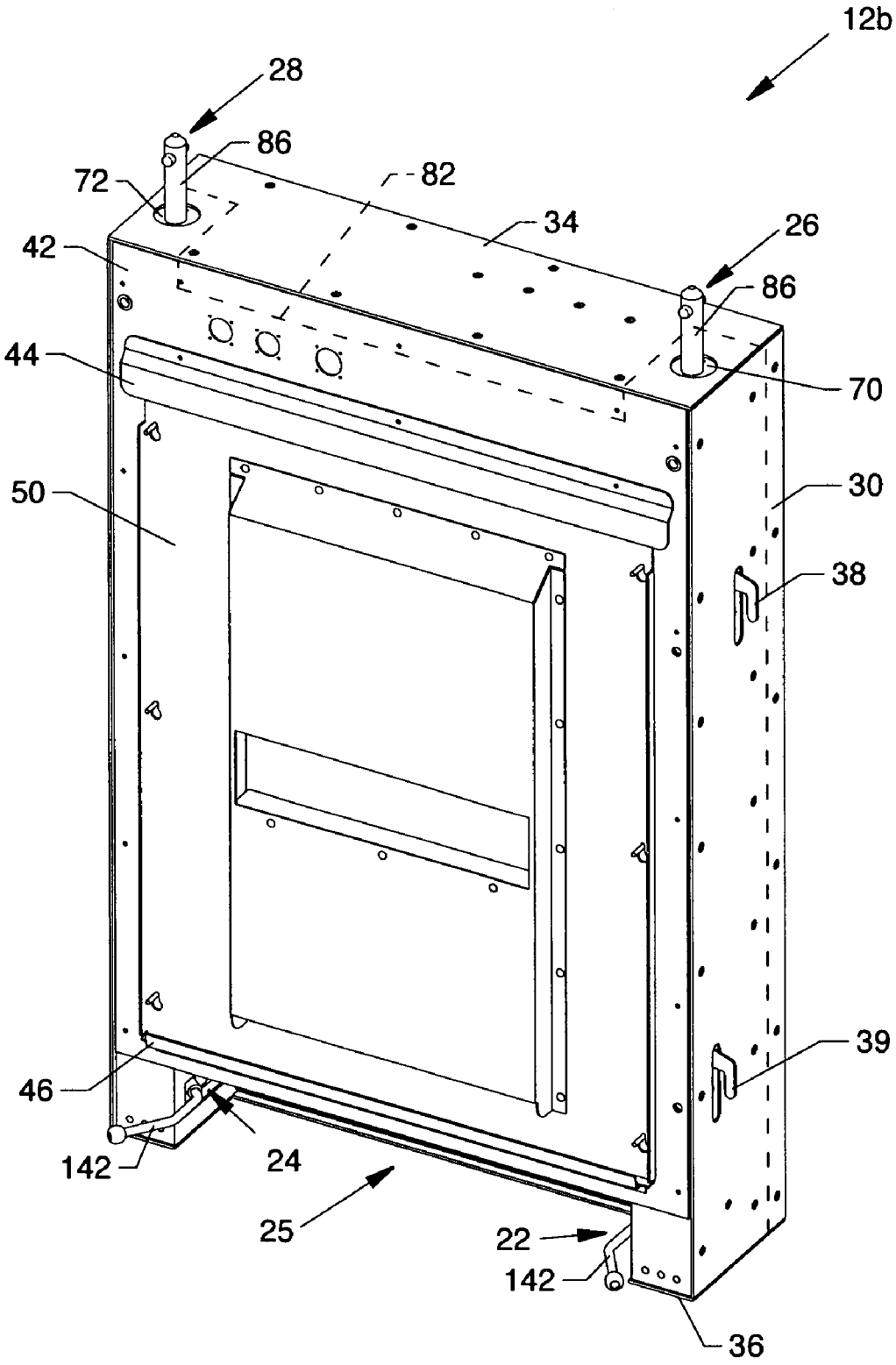
FIG. 10 is a rear isometric view of a modular display cabinet showing the male side latch assemblies extended in the locking position.

FIG. 10 is a rear isometric view of the modular display cabinet 12*b* showing the male side latch assemblies 38 and 39 extended in the locking position, such as when connected to corresponding female side latch assemblies 40 and 41 of an adjacent display cabinet 12*a*-12*b* in order to urge the vertically aligned side panels 30 and 32 of adjacent display cabinets 12*a*-12*b* into intimate contact in order to have minimum seam exposure between modular display cabinet 12*a*-12*b* and the electronic display modules 14 mounted thereto. The actuating handles 142 are shown in the open and unlocked position.

Figure 11:
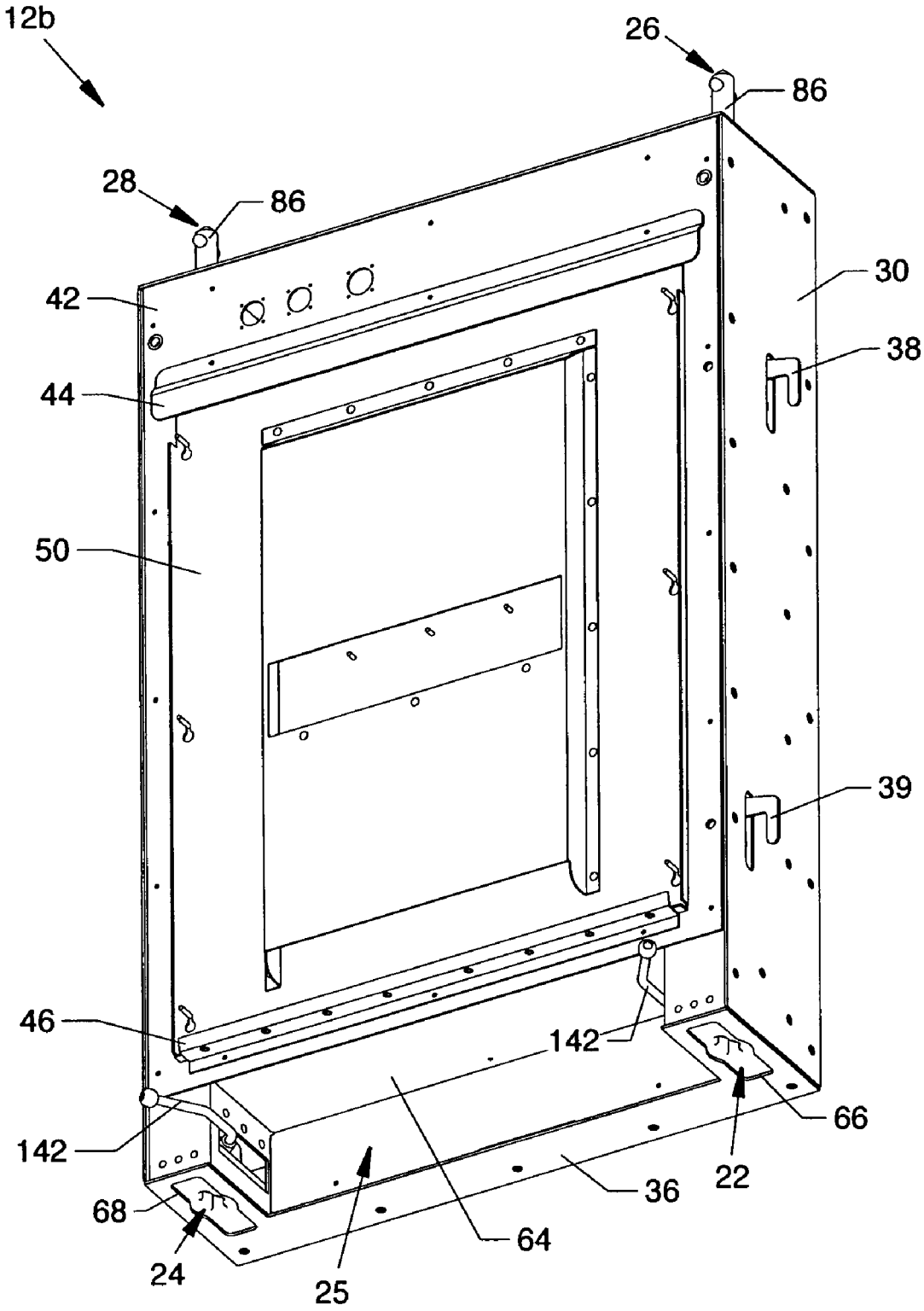
FIG. 11 is a rear isometric view of a modular display cabinet like FIG. 10 showing the bottom of the modular cabinet; and, FIG. 12 is a rear isometric view of a plurality of connected large arrays of modular display cabinets of the invention and structure for the support thereof.

FIG. 11 is a rear isometric view of the modular display cabinet 12*b* like FIG. 10 showing the bottom of the modular cabinet 12*b*. Especially shown are the female latch assemblies 22 and 24 which are accessible through the openings 68 and 66 of the bottom panel 36 and which accommodate the shafts 86 of the male latch assemblies 26 and 28 of a lower display cabinet, such as display cabinet 12*a*.

Figure 12:
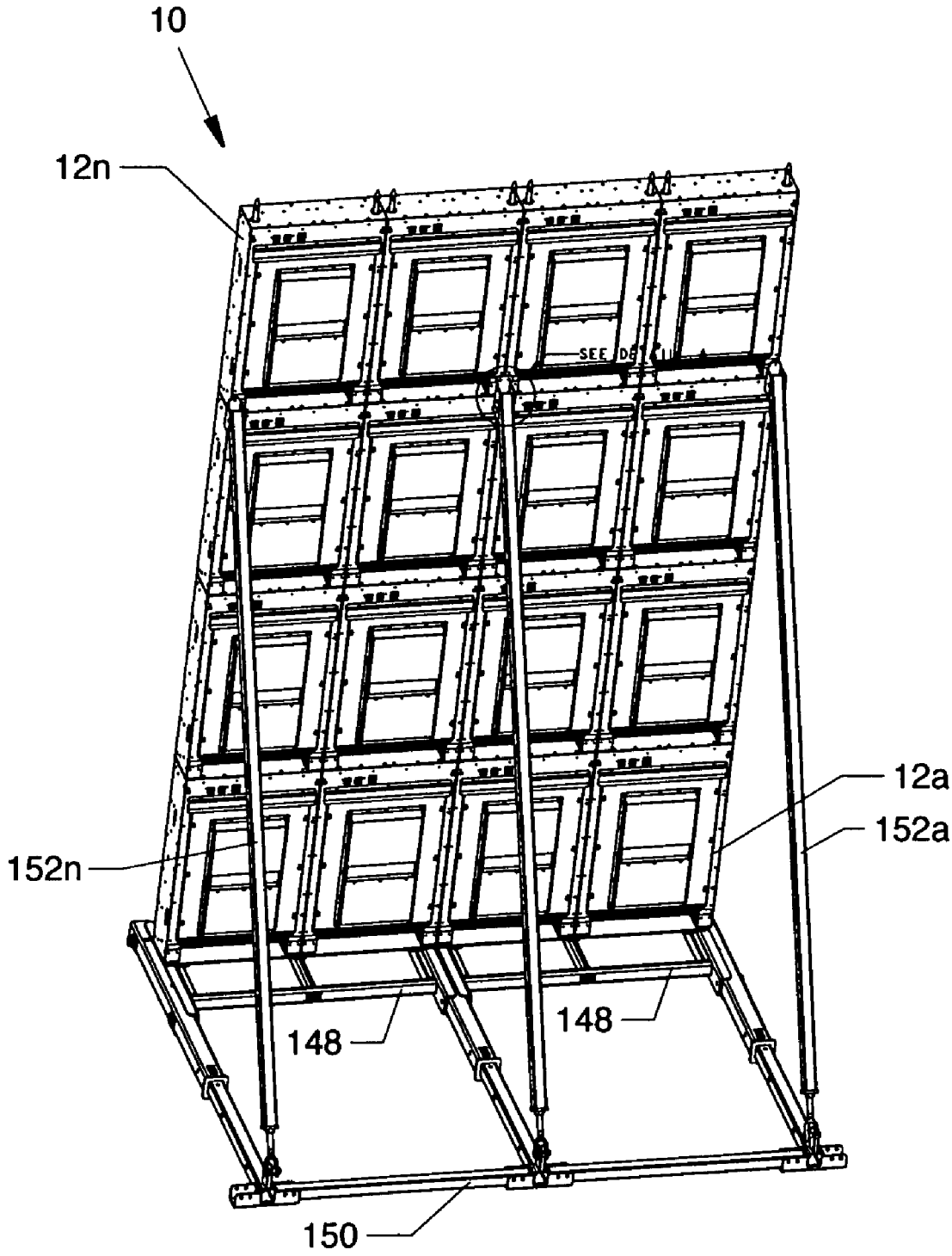

FIG. 12 is a rear isometric view of a plurality of connected large arrays of modular display cabinets 12*a*-12*n* of the invention and structure for the support thereof. Inner frames 148 are connected to and slidingly associated with a configured outer frame 150. Adjustable support bars 152*a*-152*n* connect between the rear portion of the outer frame 150 and to the upper region of the modular display cabinets 12*a*-12*n*. The bottom row of modular display cabinets can suitably attach to the inner frames 148 to allow tilting of the modular display cabinet array, if desired, by adjustment of the support bars 152*a*-152*n*.

MODE OF OPERATION

Joining of one of the modular cabinets 12*a*-12*n* to another is accomplished by placing a modular cabinet such as modular cabinet 12*a* on a suitable supportive surface followed by manually positioning another modular cabinet such as modular cabinet 12*b* over and onto the lower modular cabinet 12*a* during which the shafts 86 of the male latch assemblies 26 and 28 of the modular cabinet 12*a* engage the female latch assemblies 22 and 24 of the modular latch assembly 12*b*. During such manual positioning the wave washers 128 function as shock absorbers to minimize placement impact. Such engagement is perfected, such as described especially in FIGS. 8 and 9, by urging the actuating handles 142 of the female latch assemblies 22 and 24 in the modular cabinet 12*b* to the locked and closed position thereby forcing the lower modular cabinet 12*a* and the upper modular cabinet 12*b* into aligned and true engagement. The operator can visually inspect the position of the actuating handles 142 to determine a locked or not locked status as previously described. Further, adjacent modular cabinets 12*a* can be secured along the side panels 30 and 32 by actuating the male side latch assemblies 38 and 39 to engage the female side latches 40 and 41.

Various modifications can be made to the present invention without departing from the apparent scope thereof.

PARTS LIST

10 transportable electronic sign display system
12*a-n* modular cabinet
14 electronic display module
16 mounting panel
18 channel
20 channel
20*a* rear panel
22 female latch assembly
24 female latch assembly
25 space
26 male latch assembly
28 male latch assembly
30 side panel
32 side panel
34 top panel
36 bottom panel
38 male side latch assembly
39 male side latch assembly
40 female side latch assembly
41 female side latch assembly
42 rear access panel
44 dust cap channel
46 bracket
48 access panel cover
50 vent
52 opening
54 electronic circuitry enclosure
56 retainer plate
58 spacer mounting blocks
59 spacer mounting blocks
60 retainer plate
60*a* retainer plate
62 spacer mounting blocks
63 spacer mounting blocks
64 bracket
66 opening
68 opening
70 opening
72 opening
74 center channel
76 side lip
78 side lip
80 short extended bottom lip
82 elongated extended top lip
84 base
86 shaft
88 double keyed bore
88*a-b* slot sections
88*c-d* arcuate sections
90 mounting holes
92 body holes
94 nonthreaded section
96 threaded section
98 shoulder
100 hole
102 pin
104 hole
106 tapered tip
108 pin
110 nut
111 nut
112 base
114 adjustable rotary ramp
116 race
118 double keyed bore
120 bottom
122 mounting holes
124 bullet catches
126 washer
128 wave washer
130 double keyed bore
130*a-b* slot sections
130*c-d* arcuate sections
132 inclined ramp
134 inclined ramp
136 detent
137 detent
138 bore
140 handle mounting fixture
142 actuating handle
144 opening
146 double key bore
146*a-b* slot sections
146*c-d* arcuate sections
148 inner frame
150 outer frame
152 support bar

The invention claimed is:

1. A transportable electronic sign display system comprising:

a first modular cabinet;

second modular cabinet; and a mating latch assembly for connecting the first modular cabinet to the second modular cabinet, the mating latch assembly including:

a male latch assembly including a male latch shaft secured to the first cabinet, one or more pins project away from the male latch shaft, and, a female latch assembly including a rotary ramp rotatably coupled to the second cabinet, the rotary ramp includes:

a keyed bore extending through the rotary ramp, and the male latch shaft including the one or more pins extends through the female latch rotary ramp and is positioned within the keyed bore, and one or more inclined ramps on a face of the female latch rotary ramp opposed to the first modular cabinet, the one or more pins of the male latch shaft are movably engaged along the one or more inclined ramps.

2. The transportable electronic sign display system of claim 1, wherein the female latch assembly further includes a handle actuator for rotating the rotary ramp between an unlocked position and a locked position;

in the unlocked position the one or more pins of the male latch shaft are positioned at a base of the one or more inclined ramps of the rotary ramp in the locked position the rotary ramp is rotated around the male latch shaft extending through the keyed bore, and the one or more pins of the male latch shaft ride up the one or more inclined ramps to a position remote from the base of the inclined ramps.

3. The transportable electronic sign display system of claim 2, wherein the one or more inclined ramps of the rotary ramp engage the one or more pins to forcibly draw the male latch shaft into the keyed bore of the rotary ramp as the rotary ramp is rotated toward the locked position from the unlocked position and correspondingly draw the first cabinet toward the second cabinet.

4. The transportable electronic sign display system of claim 2, wherein the handle actuator serves as a visual reference of lock condition of the rotary ramp of the mating latch assembly.

5. The transportable electronic sign display system of claim 1, wherein the female latch assembly carries the rotary ramp in a race within a base, the base including a base keyed bore for passage of the one or more pins and the male latch shaft, the base keyed bore aligning with the keyed bore of the rotary ramp when the rotary ramp is in the unlocked position such that the pin and shaft may pass the keyed bores of both the base and the rotary ramp when the rotary ramp is in the unlocked position.

6. The transportable electronic sign display system of claim 5, wherein the female latch assembly further includes means for aiding rotation of the rotary ramp in the race and means for cushioning the rotary ramp in the race.

7. The transportable electronic sign display system of claim 5, wherein the female latch assembly further includes means for aiding rotation of the rotary ramp in the race and means for cushioning the rotary ramp in the race.

8. The transportable electronic sign display system of claim 5, wherein the female latch assembly further includes means for limiting rotation of the rotary ramp from the locked condition.

9. The transportable electronic sign display system of claim 8, wherein the means for limiting rotation is a detent in the rotary ramp and a spring loaded bullet catch in the base, which detent and spring loaded bullet catch engage in the locked position.

10. The transportable electronic sign display system of claim 5, wherein the keyed bores are double keyed bores.

11. The transportable electronic sign display of claim 10, wherein the one or more pins of the male latch shaft is a double protruding pin and the one or more inclined ramps is one of a pair of inclined ramps, which inclined ramps engage the double protruding pin to forcibly further draw the shaft into the keyed bore of the rotary ramp as the rotary ramp is rotated toward the locked position.

12. The transportable electronic sign display system of claim 1, wherein each modular cabinet has a top and a bottom and wherein the male latch assembly is mounted at the top of the first modular cabinet and the female latch assembly is mounted at the bottom of the second modular cabinet.

13. The transportable electronic sign display system of claim 12, wherein the male latch assembly is one of two opposed male latch assemblies mounted at the top of the first modular cabinet and the female latch assembly is one of two opposed female latch assemblies mounted at the bottom of the second modular cabinet.

14. The transportable electronic sign display system of claim 13, wherein the two opposed female latch assemblies are mirror images of each other.

15. The transportable electronic sign display system of claim 13, wherein each modular cabinet has a pair of opposed vertical channels and the two opposed male latch assemblies are secured in tops of the opposed vertical channels of the first modular cabinet and the two opposed female latch assemblies are secured in the bottoms of the opposed vertical channels of the second modular cabinet.

16. The transportable electronic sign display system of claim 15, wherein the opposed female latch assemblies are secured in the bottoms of the opposed vertical channels by retainer plates.

17. The transportable electronic sign display system of claim 12, further comprising means for urging the first modular cabinet into intimate contact with a horizontally adjacent third modular cabinet.

18. The transportable electronic sign display system of claim 17, wherein the means for urging includes a side latch assembly.

19. The transportable electronic sign display system of claim 1, further comprising:

a plurality of electronic display modules mounted on each of the modular cabinets.

20. The transportable electronic sign display system of claim 1 further comprising a wave washer coupled between the second cabinet and a second face of the rotary ramp facing the first cabinet, the wave washer biases the rotary ramp away from the first cabinet, and the wave washer biases the rotary ramp into engagement with the one or more pins of the male latch shaft.

21. A mating latch assembly comprising:

a male latch assembly coupled to a first cabinet the male latch assembly includes a male latch shaft having one or more pins protruding therefrom, a female latch assembly coupled to a second cabinet, the female latch assembly includes:

a rotary ramp for engaging the male latch shaft, the rotary ramp is rotatably coupled with the second cabinet and includes one or more inclined ramps, and a keyed bore extending through the rotary ramp, and the male latch shaft extends through the rotary ramp and is received within the keyed bore of the rotary ramp; and wherein the rotary ramp is rotated between an unlocked position and a locked position, in the unlocked position one or more of the pins on the male latch shaft are positioned adjacent to bases of the one or more inclined ramps, and the first cabinet is spaced from the second cabinet, and in the locked position one or more of the pins are moved up the inclined ramp and positioned away from the inclined ramp bases, the male latch shaft moves with the pins through the keyed bore and pulls the first cabinet adjacent to the second cabinet.

22. The mating latch assembly of claim 21, wherein the female latch assembly further includes a handle actuator for rotating the rotary ramp between the unlocked position and the locked position.

23. The mating latch assembly of claim 22, wherein the handle actuator serves as a visual reference of lock condition of the rotary ramp of the mating latch assembly.

24. The mating latch assembly of claim 21, wherein the female latch assembly carries the rotary ramp in a race within a base, the base including a based keyed bore for passage of the one or more pins and the male latch shaft, the base keyed bore aligning with the keyed bore of the rotary ramp when the rotary ramp is in the unlocked position such that the pin and shaft may pass the keyed bores of both the base and the rotary ramp when the rotary ramp is in the unlocked position.

25. The mating latch assembly of claim 24, wherein the female latch assembly further includes means for aiding rotation of the rotary ramp in the race and means for cushioning the rotary ramp in the race.

26. The mating latch assembly of claim 25, wherein the means for aiding rotation and the means for cushioning include a washer and a wave washer between the rotary ramp and the race.

27. The mating latch assembly of claim 24, wherein the female latch assembly further includes means for limiting rotation of the rotary ramp from the locked condition.

28. The mating latch assembly of claim 27, wherein the means for limiting rotation is a detent in the rotary ramp and a spring loaded bullet catch in the base, which detent and spring loaded bullet engage in the locked position.

29. The mating latch assembly of claim 24, wherein the keyed bores are doubled keyed bores.

30. The mating latch assembly of claim 29, wherein the one or more pins of the male latch shaft is a double protruding pin and wherein the one or more inclined ramps is one of a pair of inclined ramps, the inclined ramps engage the double protruding pin to forcibly draw the male latch shaft further into the bore of the rotary ramp as the rotary ramp is rotated toward the locked position.

31. The mating latch assembly of claim 21, wherein the female latch assembly further includes retainer plates.

32. The mating latch assembly of claim 21 further comprising a wave washer coupled between the second cabinet and the rotary ramp, the wave washer biases the rotary ramp away from the first cabinet, and the wave washer biases the rotary ramp into engagement with the one or more pins of the male latch shaft.

33. A method of assembling a transportable electronic sign, the method comprising the steps of:

providing a first modular cabinet and a second modular cabinet, each of the modular cabinets including a plurality of electronic display modules, the first modular cabinet having paired opposed male latching assemblies at the top thereof, the male latching assemblies each include a male latch shaft, and the second modular cabinet having paired opposed female latching assemblies at the bottom thereof, the female latching assemblies each include a rotary ramp with an inclined ramp and a handle actuator;

aligning the second modular cabinet above the first modular cabinet such that the male latch shafts of the male latching assemblies insert into the rotary ramps of the female latching assemblies, and the male latch shafts extend through the rotary ramps, and the first modular cabinet is spaced from the second modular cabinet; and rotating the rotary ramps of the female latching assemblies by use of the handle actuators, and rotation of the rotary ramps draws the male latch shafts through the rotary ramps and moves the first modular cabinet adjacent to the second modular cabinet.

34. The method of claim 33, further comprising the step of:

visually rechecking the position of the handle actuators to verify the condition of the latching assemblies.

35. The method of claim 33, wherein the female latching assemblies include a means for cushioning the rotary ramps such that assembly shock is reduced.

36. The method of claim 33 further comprising biasing the rotary ramp away from the first cabinet and biasing the rotary ramp into engagement with one or more pins of the male latch shaft.

* * * * *